US006722532B2

(12) United States Patent
Lasserre et al.

(10) Patent No.: US 6,722,532 B2
(45) Date of Patent: Apr. 20, 2004

(54) DISPENSER UNIT FOR SIMULTANEOUSLY DISPENSING THE CONTENTS OF TWO CONTAINERS

(75) Inventors: Pierre-Andre Lasserre, Paris (FR); Marcel Sanchez, Paris (FR); Giuseppe Dalsant, Paris (FR)

(73) Assignee: L'Oreal, Paris (FR)

( * ) Notice: Subject to any disclaimer, the term of this patent is extended or adjusted under 35 U.S.C. 154(b) by 188 days.

(21) Appl. No.: 10/034,264

(22) Filed: Oct. 19, 2001

(65) Prior Publication Data

US 2002/0117516 A1 Aug. 29, 2002

(30) Foreign Application Priority Data

Oct. 20, 2000 (FR) ..... 00 13462

(51) Int. Cl.[7] ..... B67D 5/52
(52) U.S. Cl. ..... 222/137; 222/402.13
(58) Field of Search ..... 222/137, 325, 222/402.13, 145.6

(56) References Cited

U.S. PATENT DOCUMENTS

| | | | | |
|---|---|---|---|---|
| 3,236,457 A | | 2/1966 | Kennedy et al. | |
| 4,792,062 A | | 12/1988 | Goncalves | |
| 5,169,029 A | * | 12/1992 | Behar et al. | 222/402.13 |
| 5,901,883 A | * | 5/1999 | Ritsche | 222/137 |

FOREIGN PATENT DOCUMENTS

| | | |
|---|---|---|
| DE | 100 09 233 A1 | 8/2000 |
| EP | 0 243 667 B1 | 11/1987 |
| EP | 313 414 A1 | 4/1989 |
| EP | 0 427 609 A1 | 5/1991 |
| FR | 1413164 | 4/1965 |
| FR | 2732245 A1 | 10/1996 |
| GB | 1163978 | 9/1969 |

* cited by examiner

*Primary Examiner*—Philippe Derakshani
(74) *Attorney, Agent, or Firm*—Oblon, Spivak, McClelland, Maier & Neustadt, P.C.

(57) ABSTRACT

A dispenser unit comprises a housing and an actuator movable relative to the housing to cause the contents of two containers to be dispensed simultaneously in mixed or separate state. Each container includes a hollow stem through which the substance is dispensed when the stem is depressed. The dispenser unit includes a fluid-conducting member distinct from the actuator and including two hoods for engaging the two stems of the containers. Depressing the actuator causes the fluid-conducting member to actuate the stems and initiate dispensing of the contents into a single passage or two separate passages of the fluid-conducting member. The fluid-conducting member is movable within the housing for accommodating mismatch in heights of the stems. The actuator includes a single internal channel or two separate channels for receiving the container contents from the fluid-conducting member.

60 Claims, 5 Drawing Sheets

DISPENSER UNIT FOR SIMULTANEOUSLY DISPENSING THE CONTENTS OF TWO CONTAINERS

The present invention relates to devices for dispensing two different fluid substances, such as two different hair dye components, from separate containers in which they are contained, so that the contents of the two containers are simultaneously dispensed. The present invention further relates to such devices that also mix the contents of the containers as they are being dispensed.

BACKGROUND OF THE INVENTION

Numerous devices are known that enable the fluid contents of two separate containers to be dispensed simultaneously and mixed as they are dispensed. For instance, French patent application No. FR-A-2 732 245 describes a dispenser unit comprising a housing and a pushbutton that is depressed to cause the contents of two separate containers to be dispensed. Each container includes a valve that has a hollow stem that is depressed by the pushbutton so as to open the valve and cause the container contents to be dispensed through the stem.

A difficulty with certain known dispenser units is that, because of relatively loose manufacturing tolerances for the containers, the stems may have top ends that are not situated at exactly the same height. This can result in the contents of the two containers not being dispensed simultaneously because the shorter stem may not be sufficiently depressed to open its valve.

There also exists a need for a dispenser unit that is easily modified so that a large number of its component parts can be commonly used with various containers holding different types of contents, thus making it possible to benefit from economies of scale in the manufacture of dispensers.

Other dispenser units have also been proposed, but they are not entirely satisfactory for various reasons. By way of example, mention can be made of U.S. Pat. No. 3,236,457; German patent application DE 100 09 233 A1; European patent application Nos. EP-A-0 313 414; EP-A-0 427 609; and EP-A 0 243 667; British patent No. GB 1 163 978; and French patent application Nos. FR-A-2 598 392 and FR-A-1 413 164.

SUMMARY OF THE INVENTION

The present invention addresses the above-noted needs and achieves other advantages, by providing a dispenser unit that comprises a housing structured and arranged to receive a pair of containers, an actuator such as a lever or pushbutton movably connected to the housing, and a fluid-conducting member mounted inside the housing and formed separately from and non-rigidly connected to the actuator. The containers can be pressurized and provided with valves that are opened by actuating hollow stems through which the container contents are dispensed, or unpressurized and provided with pumps that are operated by depressing the stems. The housing receives the ends of the containers from which the hollow stems project. The fluid-conducting member has two portions that receive the stems of the containers. When the stems are actuated, the contents in the containers are simultaneously dispensed into at least one passage formed in the fluid-conducting member. The actuator is structured and arranged so that driving it toward a dispensing position causes the fluid-conducting member to actuate the stems to initiate simultaneous dispensing of the container contents. The actuator includes an internal channel through which the container contents flow when being dispensed.

The invention enables satisfactory operation to be achieved in spite of any difference in height between the top ends of the two container stems.

In addition, the way in which the container contents are delivered to the actuator, i.e., whether they are delivered in a mixed state or separately, is easily modified merely by changing the structure of the fluid-conducting member. When the container contents must be mixed together before being dispensed, the actuator can include a flow deflector to promote mixing of the contents so that the mixture is more homogeneous.

In a preferred embodiment, the actuator is formed as a lever pivotally connected to the housing of the unit. Alternatively, the actuator can be a pushbutton that translates in the housing when depressed.

The fluid-conducting member advantageously includes an outlet duct through which the container contents exit in the mixed or separate state, and the actuator advantageously includes a bell-mouth or socket suitable for receiving the outlet duct. The outlet duct and bell-mouth advantageously form a loose connection that is not leakproof when the actuator is not depressed. The connection becomes fluid tight only when the actuator is depressed, thus making it possible to reduce the risks of jamming and of unintended operation.

The outlet duct preferably can be received in the bell-mouth of the actuator so that the fluid-conducting member can pivot about at least one axis relative to the actuator, and preferably about two perpendicular axes, without destroying the fluid-tight connection between the fluid-conducting member and actuator during dispensing of the container contents. Such an arrangement makes it possible to use relatively large manufacturing tolerances for the top ends of the stems.

In a particular embodiment, the housing of the dispenser unit includes internal tabs suitable for snap-fastening on collars formed on the containers.

In a particular embodiment, the actuator is snap-fastened on the housing. More particularly, the dispenser unit can include a slot and the actuator can have a catch at one end suitable for snap-fastening in the slot. The slot is advantageously located close to a wall of the housing against which the actuator abuts when moved in a direction opposite to the direction causing dispensing to take place, such that the actuator is prevented from moving farther in the opposite direction. This arrangement prevents the user from lifting the actuator far enough to gain access to the fluid-conducting member.

When the actuator is pivotally mounted, it is advantageously generally Γ-shaped when viewed in the direction of the pivot axis.

The actuator can be rigid. Preferably, the actuator can have at least one stiffening rib on an inner side, in which case the housing of the dispenser unit can include a recess enabling the stiffening rib to be received when the actuator is moved towards its dispensing position.

The actuator can include a fixing element for receiving a fitted dispenser endpiece. The dispenser endpiece can be fixed on the actuator by screw engagement. In another embodiment, the dispenser endpiece can be fixed on the actuator by snap-fastening, leaving it free to rotate about an axis.

The dispenser endpiece can be straight or bent, depending on whether dispensing is performed with the unit head-down or head-up. The free end of the dispenser endpiece can be chamfered or tapered, to enable it to penetrate more easily into the hair and part the hair.

In a particular embodiment, the fluid-conducting member includes an elongate tubular portion at least one end of which is closed by a nozzle piece whose outlet orifice is closed. The use of a nozzle piece for closing the elongate tubular portion makes it possible to take advantage of the wide availability of low-cost nozzle pieces, thus making it possible to avoid manufacturing a special plug. In a preferred embodiment, the fluid-conducting member has at least one longitudinal stiffening rib formed on the elongate tubular portion.

The dispenser unit can have at least one locking element that is movable between a locking position and a dispensing position, and serving, when in the locking position, to prevent the actuator from moving far enough to cause dispensing to take place. Such a locking element serves to avoid any risk of the container contents being dispensed accidentally while the dispenser is being transported.

In a particular embodiment, the locking element can turn relative to the actuator, being secured to or formed on the dispenser endpiece and being suitable for bearing against the housing of the dispenser unit when in the locking position.

The housing of the dispenser unit can have closure elements fitted to its top portion after the fluid-conducting member has been inserted into the housing to keep the fluid-conducting member inside.

In a particular embodiment, the housing of the dispenser unit has a pair of spaced-apart receiver tubes into which the ends of the containers are inserted to place the stems of the containers in their proper positions with respect to the fluid-conducting member. The upper ends of the tubular walls of the receiver tubes have respective notches in which the fluid-conducting member is received.

Advantageously, the fluid-conducting member has at least one rib that fits into the space between the two receiver tubes and serves to center the fluid-conducting member inside the housing of the dispenser unit.

The fluid-conducting member can be retained with perceptible slack inside the housing of the dispenser unit whenever the actuator is not depressed and the dispenser unit is waiting to be mounted on the containers.

The fluid-conducting member can be arranged to channel the container contents separately up to the actuator. The actuator can then be arranged to channel the container contents separately as far as the dispenser endpiece, or alternatively the actuator can mix the container contents.

In a further alternative embodiment, the fluid-conducting member can be arranged to mix the container contents before they reach the actuator.

The dispenser endpiece can include a mixer element for encouraging the components to mix together. Such a mixer element can be arranged to force the components to move in a direction that is not purely axial, for example to move along a path that includes one or more generally helical portions.

The mixer element can comprise a succession of identical portions through which the container contents pass in succession. The mixer element can be made separately from the dispenser endpiece and inserted into the passage of the endpiece, being retained between a shoulder inside the endpiece and the portion of the actuator on which the endpiece is mounted.

When the actuator is not moved far enough by the user, there is a risk of only one of the container valves being actuated. To reduce this risk, the dispenser unit can be arranged in such a manner that moving the actuator beyond a predetermined stroke generates an audible click that can be perceived by the user. Thus, the user knows that the actuator has been actuated far enough once the click is heard.

In a particular embodiment, the dispenser unit has at least one elastically deformable tab that is deformed in one direction while the actuator is being moved up to a certain threshold from an initial, rest position and that springs back in the opposite direction and thereby emits an audible click when the actuator is moved beyond the threshold. Such a tab can be made integrally with the housing of the dispenser unit, for example. In a particular embodiment, the housing of the dispenser unit has two click-generating tabs suitable for being deformed by the actuator.

The tab(s) can be connected to a generally plane portion of the wall of the housing and can be disposed in such a manner as to be deformed away from the plane of this wall portion when the actuator is moved. Each tab can have a width that decreases towards its free end.

In a particular embodiment, two tabs are provided on the housing of the dispenser unit to produce an audible click during displacement of the actuator, the actuator having two ribs for bearing against the tabs. The ribs can be useful for stiffening the actuator, in particular when it is generally Γ-shaped when viewed in profile.

The invention also provides a dispenser assembly comprising a dispenser unit as defined above together with two containers on which the dispenser unit is fixed.

By way of example, the containers can contain fluids that are liquid or semiliquid for mixing together on an as-needed basis. The containers can be pressurized and provided with valves, and each container can have a stem presenting a top end whose axial position is known within a tolerance greater than or equal to 0.2 mm, or even greater than or equal to 0.3 mm.

BRIEF DESCRIPTION OF THE DRAWINGS

The invention will be better understood on reading the following detailed description of non-limiting embodiments of the invention and on examining the accompanying drawings, in which.

DETAILED DESCRIPTION OF PREFERRED EMBODIMENTS

Figure 1:
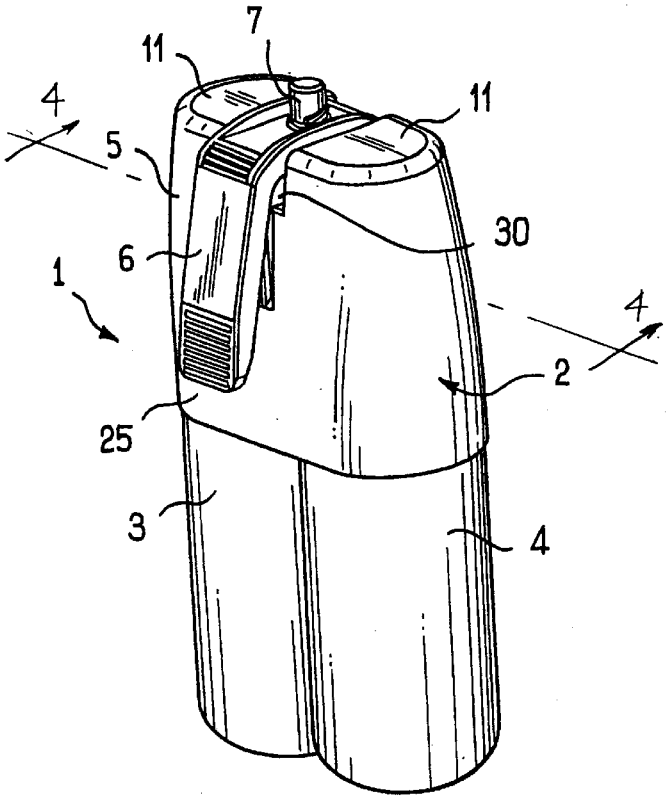
FIG. 1 is a diagrammatic perspective view of a dispenser assembly including a dispenser unit constituting a first embodiment of the invention.
Figure 2:
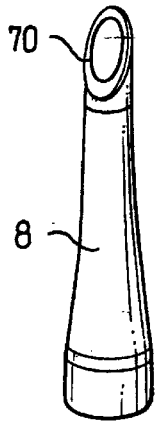
FIG. 2 is a perspective view showing a straight dispenser endpiece, in isolation, for fitting to the device of FIG. 1.
Figure 3:
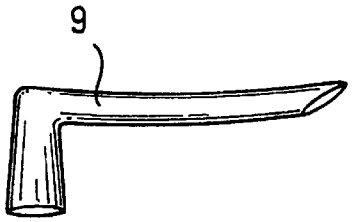
FIG. 3 is a perspective view showing a bent dispenser endpiece.

FIG. 1 shows a dispenser assembly 1 comprising a dispenser unit 2 mounted on two containers 3 and 4 containing contents for dispensing and mixing. The dispenser unit 2 comprises a housing 5 and an actuator 6 provided with a fixing element 7 for receiving a straight dispenser endpiece 8 as shown in FIG. 2 or a bent dispenser endpiece 9 as shown in FIG. 3.

Figure 4:
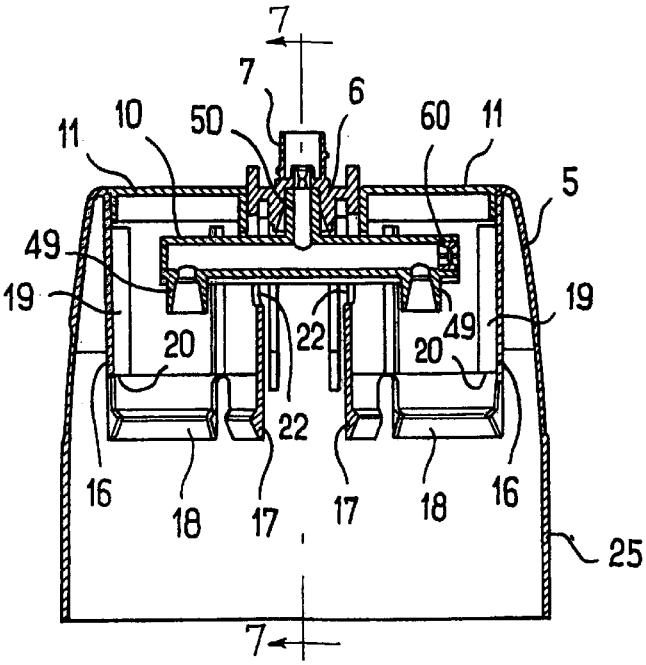
FIG. 4 is a section through the FIG. 1 dispenser unit on the plane 4—4 containing the axes of the stems, the containers being omitted.

The dispenser unit is shown in cross-section in FIG. 4 and in this figure it can be seen that the housing 5 houses a fluid-conducting member 10 whose function is described in greater detail below. The fluid-conducting member 10 and the actuator 6 are distinct, being made separately.

Figure 5:
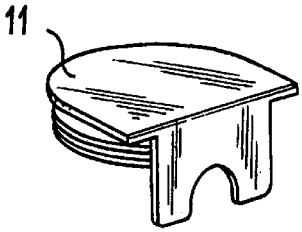
FIG. 5 shows in isolation an element for closing the housing of the dispenser unit of FIG. 1.
Figure 6:
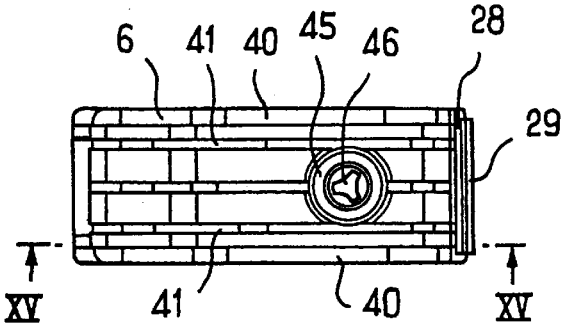
FIG. 6 is an underside view showing the actuator of the FIG. 1 dispenser device in isolation.

The housing 5 is closed on top by closure elements 11 shown in isolation in FIG. 5, which elements are arranged to snap into corresponding openings in the housing 5.

Figure 19:
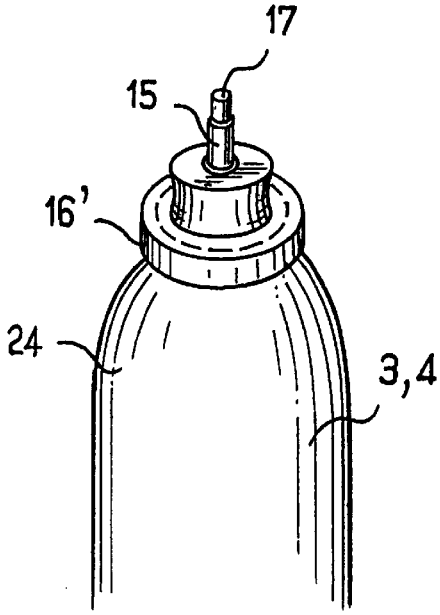
FIG. 19 shows the top portion of a container in isolation.
Figure 14:
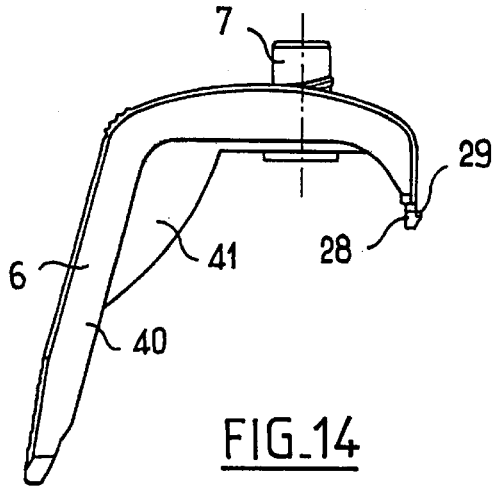
FIG. 14 is a side view of the actuator shown in isolation.
Figure 15:
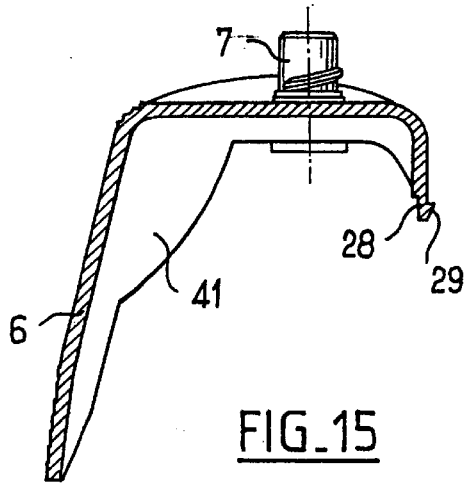
FIG. 15 is a section on section line XV—XV of FIG. 6.

Each container 3 or 4 in the embodiment described is of the pressurized aerosol can type and has its own internal valve (not shown) fitted with a valve stem 15, as can be seen in FIG. 19. The valve is held on a collar 16' of the container by crimping. The height of the top end 17 of the stem 15 is known to within a tolerance of about 0.3 mm in the embodiment described. The stem 15 is hollow and depressing the stem opens the valve so that the container contents are dispensed through the hollow stem. The valve in some types of containers includes a return spring for returning the stem to its initial position so as to close the valve when the force depressing the stem is removed.

The housing 5 has a pair of spaced-apart receiver tubes 16 each defined by a tubular wall having a split bottom end that forms resilient tabs 17. The tabs 17 on their radially inner surfaces have radially inwardly projecting catches 18 configured for snap-fastening behind the collar 16' of the corresponding container.

The tubular walls of the receiver tubes 16 are also provided on their radially inner surfaces with axial ribs 19 whose bottom ends 20 serve as abutments against which the upper ends of the containers 3, 4 abut when fully inserted into the receiver tubes 16.

Each of the receiver tubes 16 is provided at its top end with a notch 22 for receiving the fluid-conducting member 10, as described in greater detail below.

The housing 5 has an outer skirt 25 whose bottom portion covers all of the non-cylindrical top portion 24 of each of the containers 3 and 4.

Figure 8:
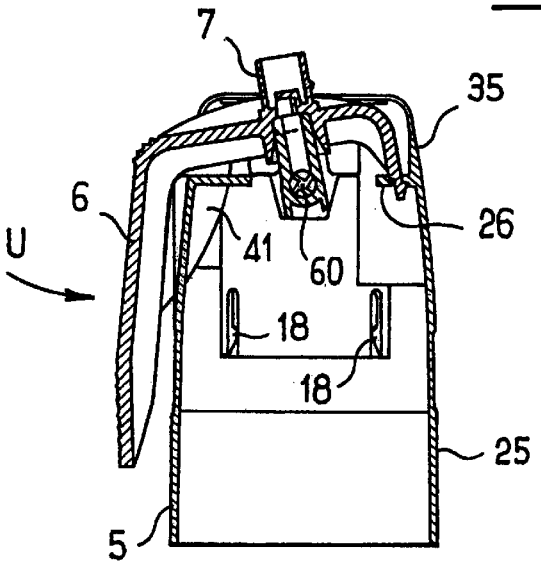
FIG. 8 is a view similar to FIG. 7 showing the actuator having been moved to cause the container contents to be dispensed.
Figure 7:
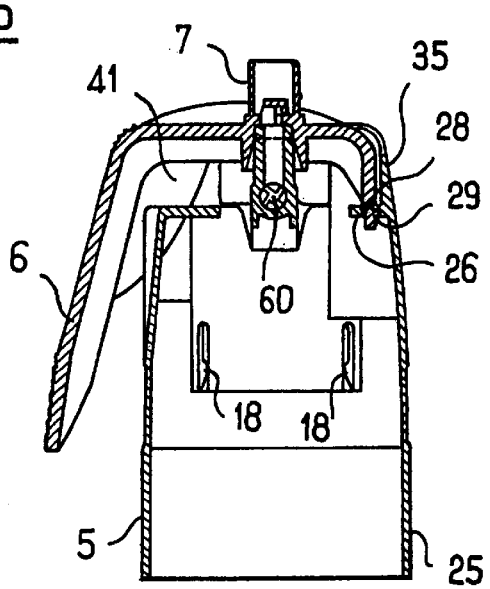
FIG. 7 is a cross-sectional view of the dispenser unit along plane 7—7 in FIG. 4, showing the dispenser unit when the actuator is at rest prior to dispensing.
Figure 12:
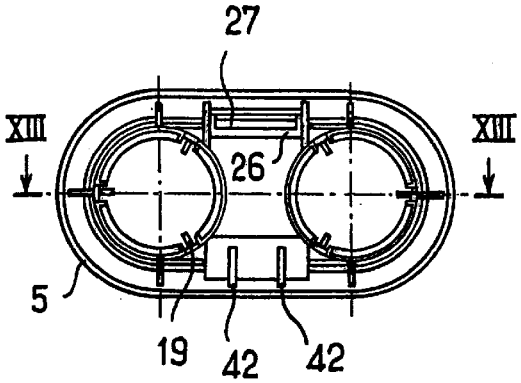
FIG. 12 is a view of the underside of the housing of the FIG. 1 dispenser unit shown in isolation.

The housing 5 has an inside tab 26 that can be seen in FIGS. 7 and 8, and a slot 27 is formed through the tab as can be seen in FIG. 12. The actuator 6 has an end 28 provided with a catch 29 suitable for snap-fastening in the slot 27, this connection leaving the actuator 6 free to pivot about an axis of rotation perpendicular to the section plane of FIGS. 7 and 8.

The housing 5 has a recess or passage 30 for the actuator 6, the passage 30 being situated on an opposite side of the housing from that having the tab 26. The tab 26 is closely spaced from a wall 35 of the housing constituting an abutment against which the actuator 6 abuts if it is rotated away from the dispensing position (clockwise in FIGS. 7 and 8). The wall 35 thus prevents the user from rotating the actuator 6 far enough to gain access to the fluid-conducting member 10.

Figure 13:
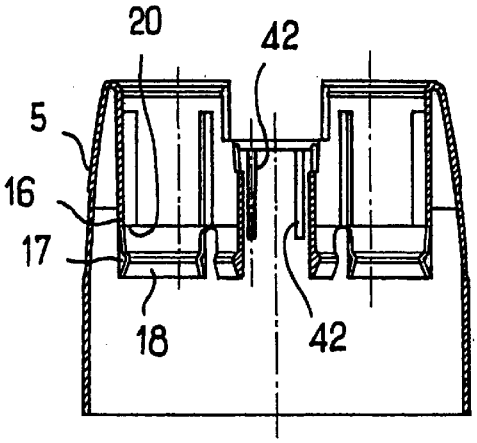
FIG. 13 is a section on line XIII—XIII of FIG. 12.

The actuator 6 is rigid, and when seen in profile as in FIGS. 7 and 8, it is generally Γ-shaped. On its inside, the actuator 6 has stiffening ribs, as can be seen in FIGS. 6 and 14 to 16. More particularly, the actuator 6 has two laterally-outer stiffening ribs 40 and two inner stiffening ribs 41. The housing 5 has two recesses 42 enabling the ribs 41 to be received, as can be seen in FIGS. 8, 12, and 13.

Figure 16:
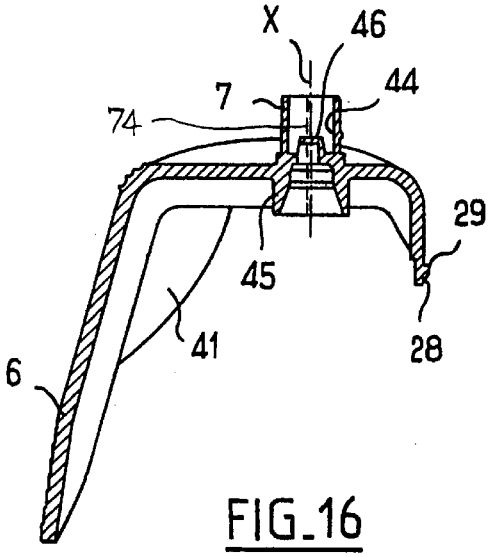
FIG. 16 is a section of the actuator on a midplane thereof.

The fixing element 7 of the actuator 6 is made integrally with the actuator, as can be seen in FIG. 16. In the embodiment shown, the fixing element 7 comprises a tube projecting upward from the actuator along an axis X and provided with a thread 44. The tube includes a portion that extends downward from the actuator and forms a socket or bell-mouth 45, likewise about the axis X. A flow deflector 46 is formed integrally with the actuator 6, at the throat of the bell-mouth 45.

Figure 9:
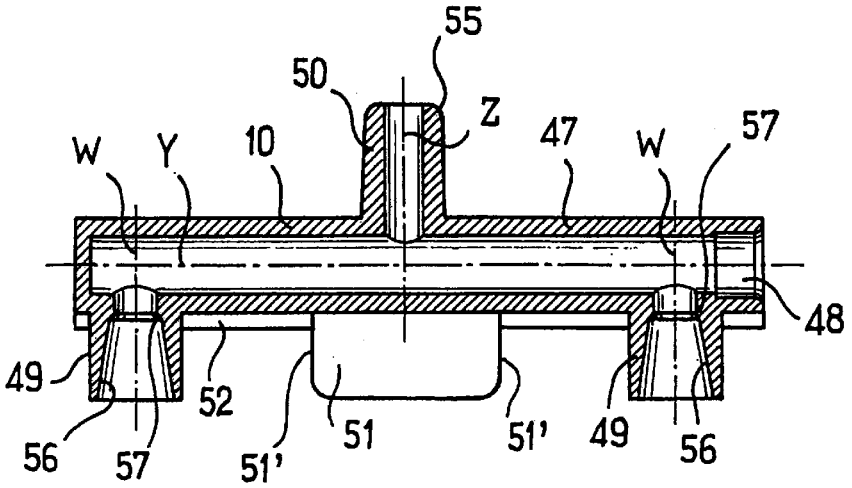
FIG. 9 shows the fluid-conducting member in isolation.
Figure 10:
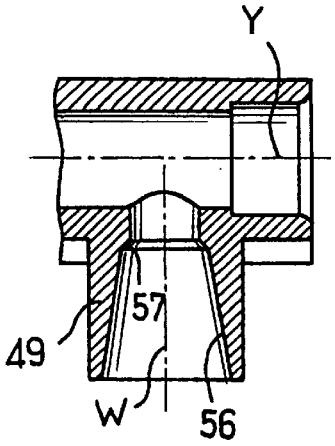
FIGS. 10 and 11 show details of FIG. 9.
Figure 11:
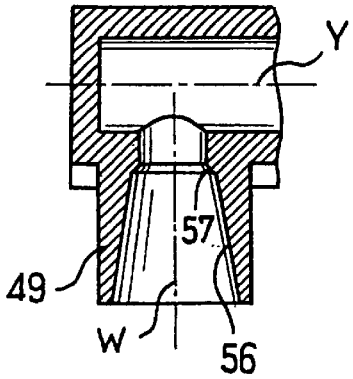

With reference to FIG. 9, the fluid-conducting member 10 comprises an elongate tubular portion 47 having a longitudinal axis Y. The tubular portion 47 is open at one end 48. The tubular portion 47 is closed at its other end 48 by means of a nozzle piece 60 whose orifice is plugged, as can be seen in FIG. 4. The fluid-conducting member also includes two hoods or receptacles 49 proximate the opposite ends of the tubular portion 47 that communicate with the inside of the elongate portion 47, and an outlet duct 50 that extends along an axis Z perpendicular to the axis Y and is situated between the hoods 49 at equal distances therefrom. The axes W of the hoods 49 are perpendicular to the axis Y. The top end 55 of the outlet duct 50 is rounded, as can be seen in FIG. 9.

The bottom of the fluid-conducting member 10, on the same side as the hoods 49, includes a central stiffening rib 51 whose ends 51' are spaced apart from the hoods 49, and the bottom of the fluid-conducting member 10 also has two longitudinal ribs 52 each extending over the entire length of the tubular portion 47.

Each hood 49 has a first portion 56 whose inside surface is conical and tapers towards a shoulder 57 against which the top end 17 of the stem 15 of the corresponding container can come to bear.

When the fluid-conducting member 10 is in place in the housing 5, the hoods 49 are positioned coaxial with the respective container receiver tubes 16, the elongate tubular portion 47 being received in the notches 22 formed in the top portions of the receiver tubes 16, the central rib 51 contributing to centering the fluid-conducting member 10 inside the housing 5 and being capable of bearing via its ends 51' against the receiver tubes 16.

Given the inside shape of the hoods 49, these are merely placed on the stems 15 when the actuator 6 is at rest, the stems 15 not being fitted in leakproof manner in the hoods 49 until the actuator 6 is depressed, causing the fluid-conducting member 10 to move down inside the housing 5.

It will be observed that the rounded end 55 of the outlet duct 50 is received in the bell-mouth 45 with the ability to rock angularly about two perpendicular axes, i.e., an axis parallel to the axis Y and an axis perpendicular to the plane defined by the axes Y and Z. This connection, which is reminiscent of a ball-and-socket joint, enables the fluid-conducting member to compensate for any difference in height between the top ends 17 of the stems 15 of the containers. The fluid-conducting member 10 can pivot within the housing 5 to accommodate different heights of the upper ends of the stems 15.

The dispenser unit 2 is put into place on the containers 3 and 4 with the fluid-conducting member 10 inside the housing 5 and with the actuator 6 in place. The dispenser unit 2 is lowered onto the adjacent containers 3 and 4 until the collars 16' of the containers become snap-fastened inside the receiver tubes 16, thus forming a dispenser assembly 1.

The dispenser assembly 1 is used as follows.

The user screws an appropriate dispenser endpiece 8 or 9 onto the fixing element 7 depending on whether the assembly is to be used head-up or head-down. It will be observed that the dispenser endpiece 8 has a free end 70 that is chamfered or tapered, making it easier to part the hair with it. To start dispensing the container contents, the user depresses the actuator 6 in the direction of arrow U in FIG. 8. When the actuator 6 is depressed, it causes the fluid-conducting member 10 to move down, thereby pressing the stems 15 downward and opening the valves of the containers 3 and 4.

The container contents are dispensed through the stems 15 into the tubular portion 47 of the fluid-conducting member 10 and are mixed together inside the tubular portion 47 when they meet at the bottom of the outlet duct 50. The mixture then reaches the dispenser endpiece 8 or 9, so as to be dispensed on the hair, for example.

Figure 17:
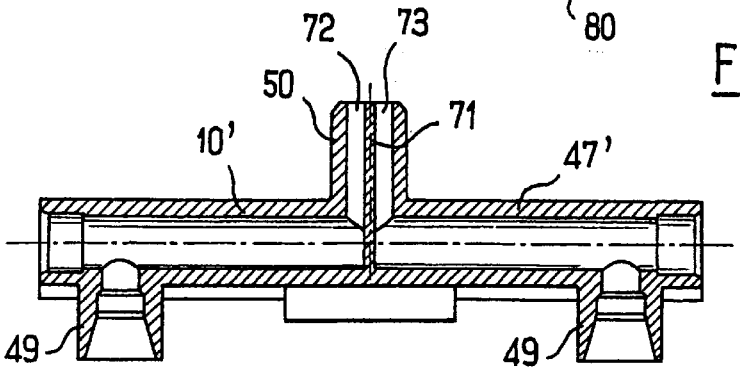
FIG. 17 shows a fluid-conducting member in accordance with an alternative embodiment of the invention.

To prevent the container contents contained in the containers 3 and 4 from mixing inside the fluid-conducting member 10, it is possible to use a fluid-conducting member 10' as shown in FIG. 17 that differs from the member shown in FIG. 9 by the fact that the elongate tubular portion 47' has openings at both axial ends and by the fact that it has an internal partition 71 subdividing the inside of the outlet duct 50 into two separate channels 72 and 73. The container contents thus start to mix only on penetrating into the dispenser endpiece 8 or 9, which makes it possible when using certain container contents to avoid any risk of clogging.

The elongate tubular portion 47' is closed at both ends by respective nozzle pieces such as the nozzle piece 60 in the preceding embodiment.

If it is desired to prevent the contents of the containers 3, 4 from mixing until they reach the dispenser endpiece 8, 9, the actuator can include an internal partition indicated by the dashed line 74 in FIG. 16 for keeping the contents separate through the actuator. It is also possible to keep the contents separate all the way through the dispenser endpiece by appropriately partitioning the dispenser endpiece (e.g., see the partition indicated by the dashed line 76 in FIG. 18) and ensuring that the separate channels in the dispenser endpiece connect to the corresponding channels in the actuator.

To prevent the device from operating accidentally, it can be provided with a locking element serving to prevent the actuator 6 from being depressed while the locking element is in the locking position.

Figure 18:
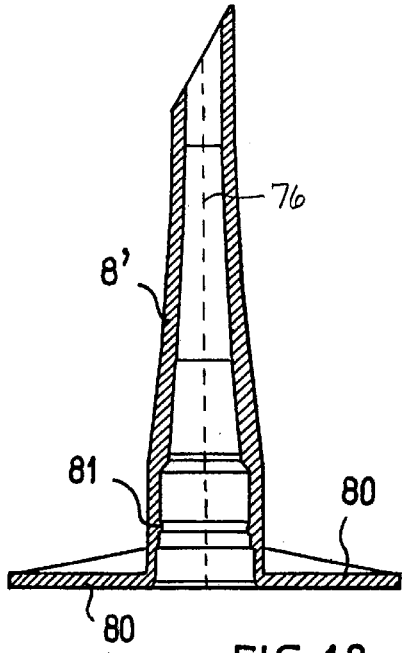
FIG. 18 shows a dispenser endpiece in accordance with an alternative embodiment of the invention.

FIG. 18 shows a straight dispenser endpiece 8' differing from that shown in FIG. 2 in that it has two diametrically opposite fins 80 at its base and in that it includes an internal bead 81 arranged to secure it by snap-fastening on a fixing element similar to the fixing element 7 as described above, but having the thread 44 replaced by snap-fastening catches in relief.

The dispenser endpiece 8 is thus free to turn about the axis X between a dispensing position in which the fins 80 are in line with the top portion of the actuator and do not interfere with it being depressed, and a locking position in which the fins 80 are placed so as to bear against the top wall of the housing 5 on either side of the actuator, thereby preventing it from being depressed.

The dispenser endpiece can receive a mixer element for improving mixing of the components.

Figure 20:
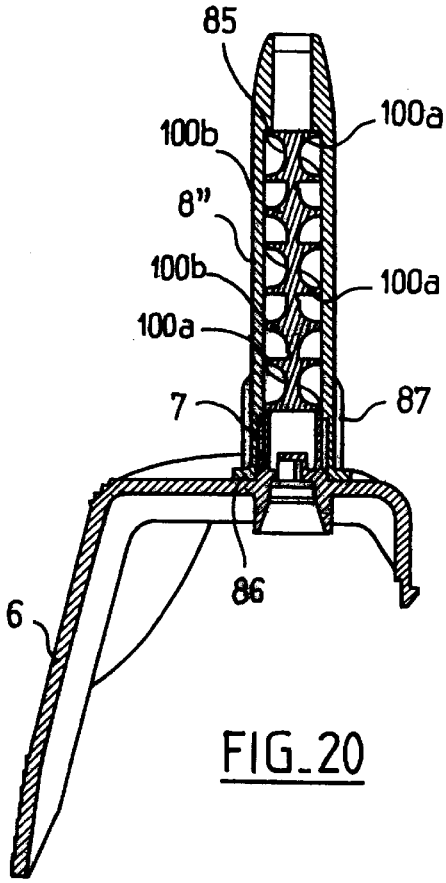
FIG. 20 is a section through the actuator and the dispenser endpiece in accordance with an alternative embodiment of the invention.
Figure 23:
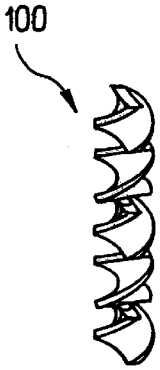
FIG. 23 is a perspective view showing the mixer element of FIG. 20 in isolation.

By way of example, FIG. 20 shows a dispenser endpiece 8" screwed onto an actuator 6 identical to that described above with reference to FIG. 16. The mixer element 100 shown in isolation in FIG. 23 is placed inside the endpiece 8". The mixer element 100 comprises a succession of sub-elements 100*a* and 100*b*, forcing each of the components that reaches the dispenser endpiece 8" to follow a path that is not rectilinear. Such a path is substantially helical in the example shown.

The top end of the mixer element 100 bears against a shoulder 85 in the endpiece 8" and its bottom end bears against the top edge of the fixing element 7. The endpiece 8" has an annular flange 86 at its bottom end that bears against the actuator 6, and it has a plurality of axial ribs 87 for making the dispenser endpiece 8" easier to hold while it is being screwed onto the actuator 6.

Figure 21:
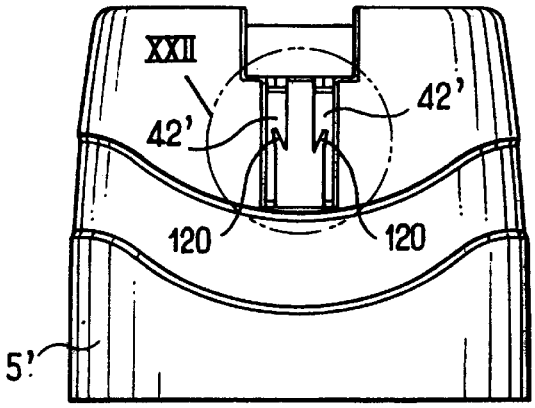
FIG. 21 is an elevation view of the housing of the dispenser unit, in accordance with an alternative embodiment of the invention.
Figure 22:
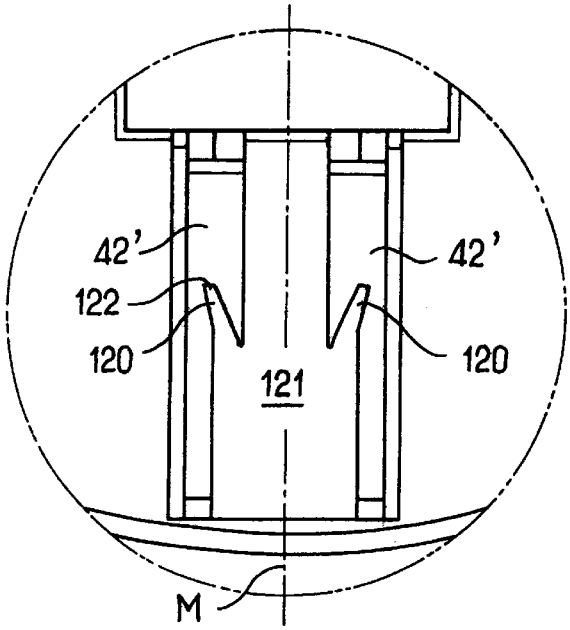
FIG. 22 shows a detail XXII of FIG. 21 on a larger scale.

FIGS. 21 and 22 show a housing 5' constituting an alternative embodiment of the invention. The housing 5' differs from the housing 5 described above in that the recesses 42 for receiving the ribs 41 are replaced by recesses 42' of such a shape as to define tabs 120 for being deformed elastically when the user presses on the actuator 6 so as to generate an audible click informing the user that the actuator 6 has been pressed sufficiently. In the embodiment shown, each tab 120 is connected to a generally plane wall portion 121 and has a free end 122 which is situated on the path of the ribs 41 while the actuator 6 is moving. Thus, the tabs 120 are deformed towards the inside of the housing 5' away from the plane of the wall portion 121 while the actuator 6 is being pressed as far as a certain threshold. Once the actuator 6 goes past said threshold, the tabs 120 tend to return elastically to their initial shape, thus generating an audible click.

On examining FIG. 22, it will be observed that the width of the tabs 120, as measured parallel to the plane of the figure, decreases towards the free ends 122 of the tabs. It will also be observed that the tabs 120 extend obliquely relative to the middle axis M of the wall portion 121. The thickness of the tabs 120 measured perpendicularly to the plane of FIG. 22 is substantially equal to the thickness of the wall portion 121, so that deformation of the tabs 120 under the effect of the actuator 6 being moved is accompanied by a small amount of deformation of the wall portion 121, thereby tending to increase the intensity of the resulting click.

From the foregoing, it will be recognized that the present invention provides a unique dispenser unit that can improve the reliability of simultaneous dispensing of the contents of two containers, and in particular can ensure that simultaneous dispensing is not interfered with even though the stems of the two containers may not be positioned at precisely the same height. The invention also enables the dispenser unit to be used with containers having different types of contents without having to modify a large part of the structure of the unit. For instance, where the container contents are such that mixing within the fluid-conducting member 10 is undesirable, a fluid-conducting member structured to keep the contents separate can be installed in the housing 5; alternatively, where mixing is desired, a fluid-conducting member configured to mix the contents can be installed. Furthermore, the invention provides a dispenser unit that provides audible feedback to the user indicating that the actuator has been depressed sufficiently for proper operation.

Many modifications and other embodiments of the invention will come to mind to one skilled in the art to which this invention pertains having the benefit of the teachings presented in the foregoing descriptions and the associated drawings. For instance, the dispenser endpiece 8, 9 can be variously configured, as can the locking element. The actuator 6 has been illustrated as being a pivotal lever, but could alternatively be a pushbutton that translates rather than pivots. It is also possible to use the dispenser unit with unpressurized containers having pumps for dispensing the contents. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dispenser unit for fixing onto a pair of containers each storing contents to be dispensed, each container at one end thereof including a hollow stem through which the contents of the container are dispensed when the stem is actuated, the dispenser unit comprising:

a housing structured and arranged to receive the pair of containers;

an actuator movably connected to the housing; and a fluid-conducting member movably disposed within the housing, the fluid-conducting member being formed separately from and being non-rigidly connected to the actuator and having at least one passage therethrough, the fluid-conducting member having portions for engaging and actuating the stems such that the contents of the containers are simultaneously dispensed into the at least one passage formed in the fluid-conducting member;

wherein the actuator is structured and arranged to be moved by a user into a dispensing position so as to displace the fluid-conducting member in a direction to actuate the stems to initiate simultaneous dispensing of the container contents, and wherein the actuator includes at least one internal channel into which the contents are delivered from the fluid-conducting member.

2. The dispenser unit of claim 1, wherein the actuator is hinged.

3. The dispenser unit of claim 1, wherein the fluid-conducting member has an outlet duct through which the contents exit in a separate or mixed state, and wherein the actuator has a bell-mouth configured for receiving said outlet duct.

4. The dispenser unit of claim 3, wherein the outlet duct and the bell-mouth form a connection that is not leakproof when the actuator is at rest.

5. The dispenser unit of claim 3, wherein the outlet duct is received in the bell-mouth of the actuator with the ability to pivot about at least one axis relative to the actuator.

6. The dispenser unit of claim 5, wherein the outlet duct is received in the bell-mouth of the actuator with the ability to pivot about two perpendicular axes relative to the actuator.

7. The dispenser unit of claim 1, wherein the housing of the dispenser unit has internal tabs configured for snap-fastening on collars formed on the containers.

8. The dispenser unit of claim 1, wherein the actuator is fixed on the housing by snap-fastening.

9. The dispenser unit of claim 8, wherein the housing of the dispenser unit has a slot and wherein the actuator has a catch at one end configured for snap-fastening in said slot.

10. The dispenser unit of claim 9, wherein the slot is spaced from a wall against which the actuator abuts when moved in a direction opposite from the direction that gives rise to dispensing, said wall preventing the user from lifting the actuator far enough to gain access to the fluid-conducting member.

11. The dispenser unit of claim 1, wherein the actuator is pivotally mounted and presents a profile that is generally Γ-shaped when observed along a pivot axis thereof.

12. The dispenser unit of claim 1, wherein the actuator is rigid.

13. The dispenser unit of claim 12, wherein the actuator has at least one stiffening rib on an inner side, and wherein the housing of the dispenser unit includes a recess configured for receiving said stiffening rib when the actuator is moved towards the dispensing position.

14. The dispenser unit of claim 1, wherein the actuator receives a dispenser endpiece mounted thereon.

15. The dispenser unit of claim 14, wherein the dispenser endpiece is fixed on the actuator by screw engagement.

16. The dispenser unit of claim 14, wherein the dispenser endpiece is fixed on the actuator by snap-fastening such that the dispenser endpiece is rotatable about an axis relative to the actuator.

17. The dispenser unit of claim 14, wherein the dispenser endpiece is straight.

18. The dispenser unit of claim 14, wherein the dispenser endpiece is bent.

19. The dispenser unit of claim 14, wherein the dispenser endpiece has a free end that is tapered.

20. The dispenser unit of claim 1, wherein the actuator has a flow deflector.

21. The dispenser unit of claim 1, wherein the fluid-conducting member comprises an elongate tubular portion at least one end of which is closed by a nozzle piece whose outlet orifice is plugged.

22. The dispenser unit of claim 1, including at least one locking element movable between a locking position and a dispensing position, the locking element when in the locking position serving to prevent the actuator from moving far enough to cause the contents of the containers to be dispensed.

23. The dispenser unit of claim 22, wherein the locking element can turn relative to the actuator, being secured to a dispenser endpiece and being configured for coming to bear against the housing of the dispenser unit when in the locking position.

24. The dispenser unit of claim 1, wherein the fluid-conducting member has at least one longitudinal stiffening rib.

25. The dispenser unit of claim 1, wherein the housing of the dispenser unit has closure elements fitted to a top end of the housing, the closure elements being put into place after the fluid-conducting member has been inserted inside the housing of the dispenser unit so as to hold the fluid-conducting member therein.

26. The dispenser unit of claim 1, wherein the housing of the dispenser unit has receiver tubes for receiving the containers, and wherein tubular walls of the receiver tubes have notches in which the fluid-conducting member is received.

27. The dispenser unit of claim 26, wherein the fluid-conducting member has at least one rib engaging between the receiver tubes so as to center the fluid-conducting member inside the housing.

28. The dispenser unit of claim 1, wherein the fluid-conducting member is retained with perceptible slack inside the housing of the dispenser unit whenever the actuator is not being driven and the dispenser unit is waiting to be mounted on the containers.

29. The dispenser unit of claim 1, wherein the at least one passage in the fluid-conducting member comprises two separate passages arranged to channel the contents separately up to the actuator.

30. The dispenser unit of claim 29, wherein the actuator includes two separate internal channels that are respectively placed in fluid communication with the two passages of the fluid-conducting member at least when the actuator is driven to the dispensing position, whereby the actuator is arranged to channel the contents separately.

31. The dispenser unit of claim 1, wherein the fluid-conducting member is structured and arranged to mix the contents of the two containers as the contents flow therethrough.

32. The dispenser unit of claim 1, further comprising a dispenser endpiece mounted on the actuator and including a mixer element for mixing the contents of the two containers.

33. The dispenser unit of claim 32, wherein the mixer element is arranged to force the contents to travel in a direction that is not purely axial.

34. The dispenser unit of claim 33, wherein the mixer element is arranged to force the contents to travel along a path that includes one or more generally helical portions.

35. The dispenser unit of claim 32, wherein the mixer element comprises a succession of identical portions through which the contents pass in succession.

36. The dispenser unit of claim 32, wherein the mixer element is made separately from the dispenser endpiece and is held axially therein between a shoulder formed in the dispenser endpiece and a portion of the actuator on which the dispenser endpiece is mounted.

37. The dispenser unit of claim 1, the unit being structured and arranged such that moving the actuator beyond a predetermined stroke produces an audible click that is perceptible to the user.

38. The dispenser unit of claim 37, including at least one elastically-deformable tab that is deformed in one direction while the actuator is being moved up to a certain threshold from an initial rest position, and springs back in the opposite direction once the actuator has gone past said threshold.

39. The dispenser unit of claim 37, including at least one tab made on the housing in order to issue an audible click when the actuator is moved to dispense the contents.

40. The dispenser unit of claim 39, wherein the housing has two tabs configured for being deformed by moving the actuator.

41. The dispenser unit of claim 39, wherein said at least one tab is connected to a generally plane wall portion and is disposed in such a manner as to be deformed out from the plane of said wall portion when the actuator is moved.

42. The dispenser unit of claim 41, wherein a dimension of said tab decreases towards a free end of the tab.

43. The dispenser unit of claim 38, wherein two tabs are formed on the housing in order to produce an audible click during displacement of the actuator, and wherein the actuator has two ribs configured for pressing against said tabs.

44. A dispenser assembly comprising a dispenser unit as defined in claim 1 together with two containers on which said dispenser unit is fixed.

45. The dispenser assembly of claim 44, wherein the containers contain contents for dispensing and mixing.

46. The dispenser assembly of claim 44, wherein the containers are pressurized.

47. The dispenser assembly of claim 46, wherein the containers are provided with valves having stems presenting respective top ends whose axial positions are known with a tolerance not better than about 0.2 mm.

48. The dispenser assembly of claim 46, wherein the containers are provided with valves having stems presenting respective top ends whose axial positions are known with a tolerance not better than about 0.3 mm.

49. The dispenser assembly of claim 44, wherein the containers include pumps connected to the stems such that depressing the stems causes the contents to be pumped up through the stems.

50. A dispenser unit for fixing onto a pair of containers each storing contents to be dispensed, each container at one end thereof including a hollow stem through which the contents of the container are dispensed when the stem is depressed, the dispenser unit comprising:

a housing structured and arranged to receive the pair of containers arranged side-by-side;

an actuator movably connected to the housing; and a fluid-conducting member formed separately from the actuator and having at least one passage therethrough, the fluid-conducting member having portions for engaging the stems such that the contents of the containers are simultaneously dispensed into the at least one passage formed in the fluid-conducting member;

wherein the actuator is structured and arranged to be moved into a dispensing position so as to displace the fluid-conducting member in a direction to depress the stems to initiate simultaneous dispensing of the container contents, and the fluid-conducting member is pivotable relative to the housing to accommodate a mismatch in heights of the two stems.

51. The dispenser unit of claim 50, wherein the actuator defines at least one internal channel through which the container contents can flow, the actuator being connected to the fluid-conducting member such that the container contents dispensed into the at least one passage of the fluid-conducting member flow into the at least one internal channel of the actuator for dispensing therefrom.

52. The dispenser unit of claim 51, wherein the fluid-conducting member has an outlet duct projecting therefrom, and the actuator defines a socket for receiving the outlet duct so as to put the internal channel of the actuator in fluid communication with the at least one passage in the fluid-conducting member.

53. The dispenser unit of claim 52, wherein the outlet duct and the socket form a loose connection that is not leak-proof when the actuator is not in said dispensing position.

54. The dispenser unit of claim 53, wherein the outlet duct and socket are formed such that the fluid-conducting member can pivot relative to the actuator about at least one axis while maintaining a fluid tight connection between the outlet duct and socket when the actuator is in said dispensing position.

55. The dispenser unit of claim 50, wherein the actuator is pivoted toward the dispensing position to dispense the container contents, and an end of the actuator is pivotally engaged in the housing at a position spaced from a wall of the housing, the end of the actuator and the wall being arranged such that said end abuts said wall when the actuator is pivoted in an opposite direction away from said dispensing position, said wall thereby preventing further pivoting of the actuator in said opposite direction.

56. The dispenser unit of claim 50, further comprising a dispenser endpiece rotatably fixed on the actuator and including portions that interfere with the housing and prevent the actuator from being moved to the dispensing position when the endpiece is rotated to a locked position, the endpiece being further rotatable to an unlocked position in which said portions of the endpiece do not interfere with movement of the actuator to the dispensing position.

57. The dispenser unit of claim 50, wherein the unit is structured and arranged such that moving the actuator past a threshold toward the dispensing position produces an audible click.

58. The dispenser unit of claim 57, wherein the audible click is produced by at least one elastically deformable tab that is deformed from an initial position while the actuator is being moved up to said threshold and springs back toward said initial position once the actuator is moved past said threshold.

59. The dispenser unit of claim 58, wherein the at least one elastically deformable tab is formed on the housing.

60. The dispenser unit of claim 50, in combination with a pair of containers containing contents to be dispensed, wherein ends of the containers that have the stems are engaged in the housing.

* * * * *